US008342868B2

(12) United States Patent
Puettner et al.

(10) Patent No.: US 8,342,868 B2
(45) Date of Patent: Jan. 1, 2013

(54) DIRECT PLUG-IN CONNECTION INCLUDING A CABLE END SLEEVE

(75) Inventors: Achim Puettner, Aalen (DE); Hartmut Buschle, Fellbach (DE); Michael Schoenfeld, Leinfelden-Echterdingen (DE); Peter Rehbein, Weissach (DE); Andreas Simmel, Schwaikheim (DE)

(73) Assignee: Robert Bosch GmbH, Stuttgart (DE)

( * ) Notice: Subject to any disclaimer, the term of this patent is extended or adjusted under 35 U.S.C. 154(b) by 543 days.

(21) Appl. No.: 10/589,058

(22) PCT Filed: Jan. 31, 2005

(86) PCT No.: PCT/EP2005/050399

§ 371 (c)(1),
(2), (4) Date: Aug. 11, 2006

(87) PCT Pub. No.: WO2005/081365

PCT Pub. Date: Sep. 1, 2005

(65) Prior Publication Data

US 2007/0167048 A1 Jul. 19, 2007

(30) Foreign Application Priority Data

Feb. 19, 2004 (DE) ..... 10 2004 008 014

(51) Int. Cl.
*H01R 13/15* (2006.01)

(52) U.S. Cl. ..... 439/260

(58) Field of Classification Search ..... 439/260, 439/660, 637, 86, 112; 29/861, 863
See application file for complete search history.

(56) References Cited

U.S. PATENT DOCUMENTS

| | | | | | |
|---|---|---|---|---|---|
| 3,218,603 | A | * | 11/1965 | Sanislo | 439/633 |
| 3,941,448 | A | * | 3/1976 | Evans | 439/493 |
| 4,054,742 | A | | 10/1977 | Bonhomme | |
| 4,545,632 | A | * | 10/1985 | Maier et al. | 439/43 |
| 4,568,138 | A | * | 2/1986 | McKenzie | 439/723 |
| 5,306,160 | A | * | 4/1994 | Roberts | 439/62 |
| 5,620,329 | A | * | 4/1997 | Kidd et al. | 439/248 |
| 5,762,525 | A | * | 6/1998 | Candeloro | 439/660 |
| 5,960,540 | A | | 10/1999 | Pentz et al. | |
| 5,971,806 | A | * | 10/1999 | Evans et al. | 439/632 |
| 6,010,370 | A | * | 1/2000 | Aihara et al. | 439/660 |
| 6,299,476 | B1 | * | 10/2001 | Schramme et al. | 439/496 |
| 6,371,817 | B1 | * | 4/2002 | Shi et al. | 439/660 |
| 6,857,908 | B2 | * | 2/2005 | Burmeister | 439/632 |
| 2002/0004341 | A1 | | 1/2002 | Hayashi et al. | |
| 2003/0139079 | A1 | * | 7/2003 | Longueville et al. | 439/260 |

FOREIGN PATENT DOCUMENTS

GB 1 505 207 3/1978

* cited by examiner

*Primary Examiner* — Amy Cohen Johnson
*Assistant Examiner* — Vladimir Imas
(74) *Attorney, Agent, or Firm* — Kenyon & Kenyon LLP

(57) ABSTRACT

A removable electrical plug-in connection comprising a connector and a mating connector, the mating connector including a contact element, in particular a p.c. board, or similar, having at least one contact area which is connectable at least in part to the connector. It is provided that the connector includes at least one clamping element which grips at least in part around the contact element in its contact position, and this clamping element presses at least a part of the contact element against the contact area for establishing the electrical plug-in connection.

16 Claims, 2 Drawing Sheets

DIRECT PLUG-IN CONNECTION INCLUDING A CABLE END SLEEVE

FIELD OF THE INVENTION

The invention relates to a removable electrical plug-in connection made up of a connector and a mating connector; the mating connector includes a p.c. board and has at least one contact area which is connectable at least in part to the connector.

DESCRIPTION OF RELATED ART

Plug-in connections in varied designs are known. As a rule, they are made up of a connector, e.g., a plug, which is insertable into a mating connector, e.g., a socket, in order to establish a removable electrical plug-in connection. Both connectors are connected to cables. With its outside diameter, the connector is in contact, at least in part, with the inside diameter of a socket of a mating connector, thereby establishing an electrical contact.

Other mating connector designs have p.c. boards on which switching elements are situated. In addition, these p.c. boards also have contact areas into which connectors are insertable. As a rule, these contact areas are sockets which are situated directly on the p.c. board.

The above-described design according to the related art has the disadvantage that this is not a reliable electrical connection which is able to withstand fretting corrosion. Micromovements between the contacts and great insertion forces, which are necessary to prevent unintentional loosening, cause, in multipole plug-in connections in particular, this type of corrosion which has an adverse effect on the quality of the electrical plug-in connection. Furthermore, only expensive and, in technical terms, complex approaches for contacts are known, which meet the high technical demands such as current transfer, insertion cycles, shaking, etc.

SUMMARY OF THE INVENTION

It is an object of the invention to propose a reliable electrical and removable plug-in connection in which a connector is contactable with a mating connector and in which the mating connector has a contact element, e.g., in the form of a board, p.c. board, or similar.

This and other objects of the invention are achieved by a removable electrical plug-in connection comprising a connector and a mating connector, the mating connector including a contact element, in particular a p.c. board, or similar, having at least one contact area which is connectable at least in part to the connector, wherein the connector includes at least one clamping element which grips at least in part around the contact element in its contact position, and this clamping element presses at least a part of the contact element against the contact area for establishing the electrical plug-in connection.

BRIEF DESCRIPTION OF THE DRAWINGS

The invention will be described in greater detail with reference to the following drawings wherein.

DETAILED DESCRIPTION OF THE INVENTION

One of the advantages of the present invention is that the proposed connecting technology is very space-saving and finds sufficient space in a housing of a connector. In addition, the connection may be securely established, so that an electrical plug-in connection is ensured in any type of combination of connector and mating connector.

Furthermore, it is an advantage that an electrical connection may be established directly so that the pins or male connectors of an electrical plug-in connection, customary per se, are no longer necessary. Pins or male connectors may be avoided in this way. In addition, this type of design of an electrical plug-in connection may be very easily used in sensors, valves, or similar components in which a removable electrical plug-in connection is to be implemented, but in which the necessary installation space for this is extremely limited.

Figure 1:
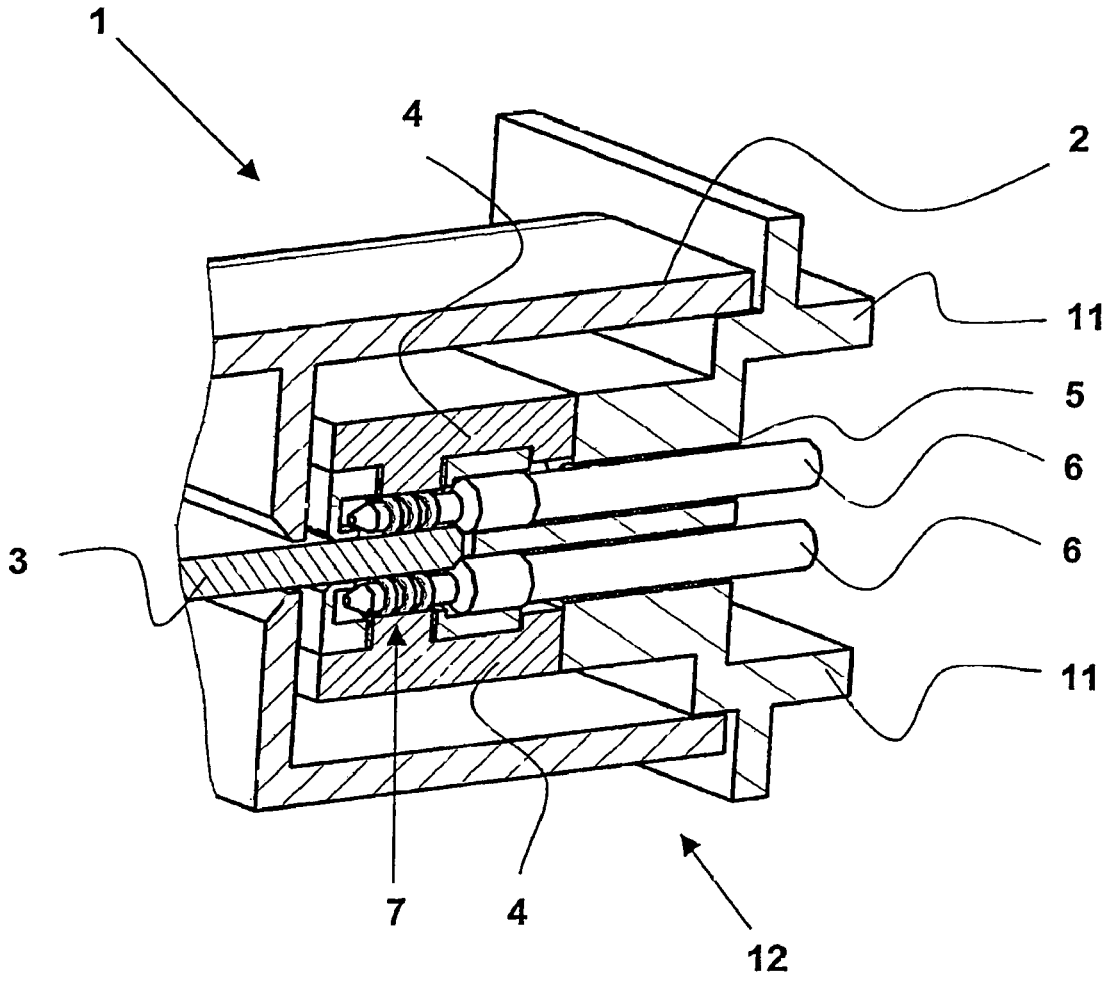
FIG. 1 shows a perspective view of the mating connector according to the present invention including partially shown contact elements.

FIG. 1 shows a mating connector 1 in section. It is made up of a housing 2 as well as a contact element 3 situated in the housing, contact element 3 being a p.c. board in this exemplary embodiment. Connector 12 is made up of a contact carrier 11, contact element 6 and clamping elements 4 which are situated on both sides of contact elements 6. Contact carrier 11 additionally has apertures 5, through which contact elements 6 are insertable. Connector 12 may include a plurality of contact elements 6 shown here (multi-pole plug connector).

In contact position, as it is shown in FIG. 1, contact elements 6 end in contact area 7 of contact element 3. The ends of the contact element 6 are designed in such a way that they are in contact on both sides of contact element 3 in its longitudinal extension, thereby establishing an electrical connection between contact element 6 and contact element 3 of mating connector 1. For fixing contact elements 6 on contact element 3, clamping elements 4 of contact carrier 11 are provided which, in the exemplary embodiment shown here, grip around the ends of contact element 6, at least partially, and press contact element 6 against contact areas 7 of contact element 3.

The clamping effect of clamping elements 4 may be created in different ways:

First, there is the possibility that clamping elements 4 are displaceably positioned elements which effect fixing of contact elements 6 either by joining contact carrier 11 or by using actuators, which are not shown in the drawing in greater detail.

Second, there is the possibility that clamping elements 4 have latching elements, into which contact elements 6 latch in their contact position (as shown in the drawing).

Figure 2:
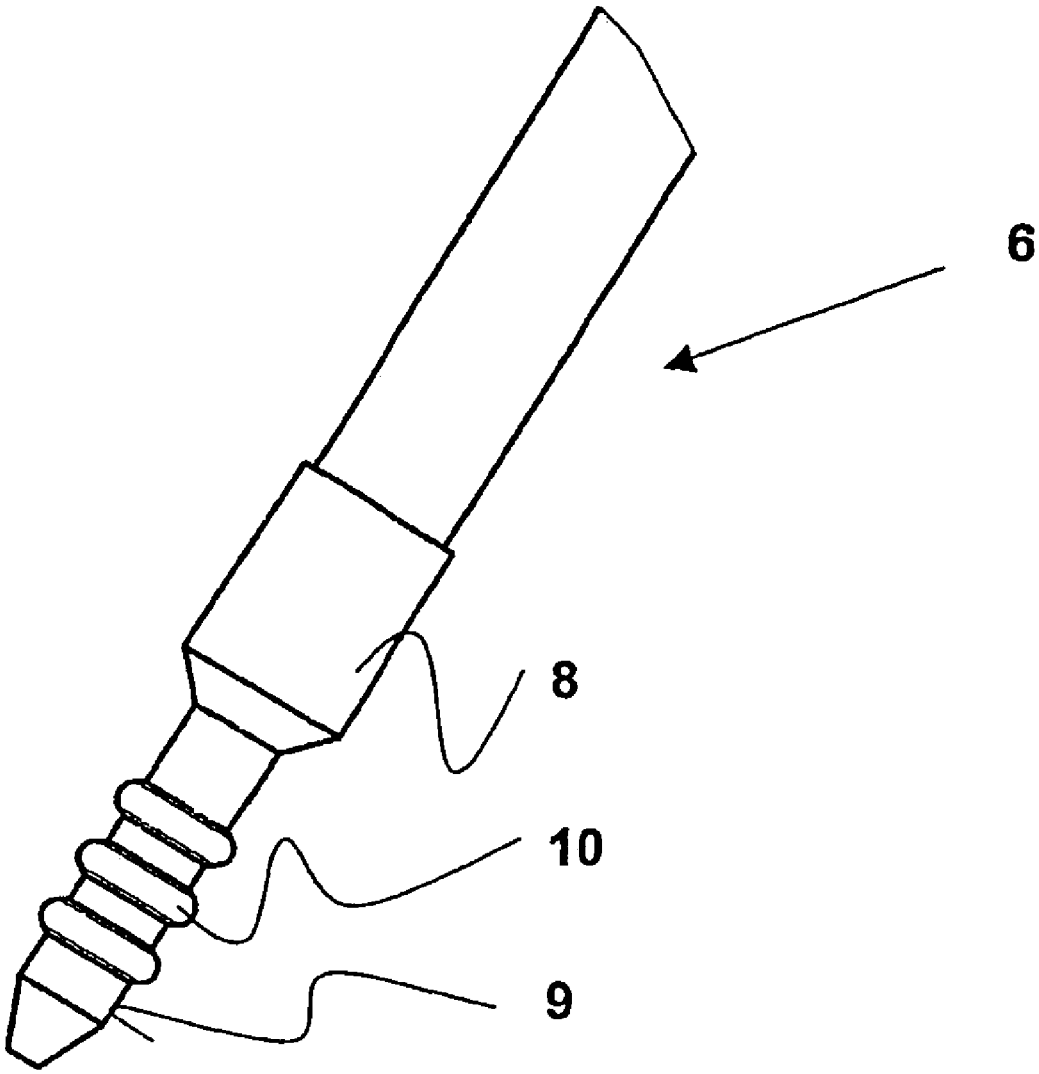
FIG. 2 shows a perspective view of an exemplary embodiment of a contact element.

In order to create an optimized contact possibility between contact element 3 and contact element 6, provision is made to use contact element 6 including a sleeve 8 as it is shown in FIG. 2. This sleeve 8 is made of an electrically conductive material which is slid over the contact area of contact element 6. Beads 10 are provided on outer surface 9 of sleeve 8 which create defined contact points with contact element 3 in contact area 7. As an alternative, sleeve 8 is also fixable via an at least partially insulated end of a cable, thereby creating a connector in a simple manner. This creates the possibility of omitting male connectors and pins and avoiding complex connecting methods between the male connectors or pins and the cable end.

What is claimed is:

1. A removable electrical plug-in connection comprising:

a connector; and a mating connector, the mating connector including a first contact element (3) having at least one contact area which is connectable at least in part to the connector, wherein the connector (12) includes at least one clamping element (4) which grips at least in part around a second contact element (6) in its contact position, and this clamping element (4) presses at least a part of the second contact element (6) against the contact area (7) for establishing the electrical plug-in connection, wherein the second contact element (6) has a sleeve (8) at least in the contact area (7) for compensating different diameters of second contact elements (6), wherein an outer surface (9) of the sleeve (8) includes at least one bead (10) forming a contact point with the first contact element (3) in the contact area (7).

2. The plug-in connection according to claim 1, wherein the clamping element (4) is positioned displaceably within the connector (12) and latches in its contact position.

3. The plug-in connection according to claim 1, wherein the clamping element (4) has latching means with which the second contact element (6) latches together.

4. The plug-in connection according to claim 1, wherein the clamping element (4) is designed in such a way that the second contact element (6) is fixed in its longitudinal extension on at least one side of the first contact element (3) at least in part in the contact area (7).

5. The plug-in connection according to claim 2, wherein the clamping element (4) is designed in such a way that the second contact element (6) is fixed in its longitudinal extension on at least one side of the first contact element (3) at least in part in the contact area (7).

6. The plug-in connection according to claim 3, wherein the clamping element (4) is designed in such a way that the second contact element (6) is fixed in its longitudinal extension on at least one side of the first contact element (3) at least in part in the contact area (7).

7. The plug-in connection according to claim 1, wherein the second contact element (6) is pressed against the contact area (7) of the first contact element (3) when the connector (12), made up of the second contact element (6), a contact carrier (11) and the clamping element (4), is closed.

8. The plug-in connection according to claim 2, wherein the second contact element (6) is pressed against the contact area (7) of the first contact element (3) when the connector (12), made up of the second contact element (6), a contact carrier (11) and the clamping element (4), is closed.

9. The plug-in connection according to claim 4, wherein the second contact element (6) is pressed against the contact area (7) of the first contact element (3) when the connector (12), made up of the second contact element (6), a contact carrier (11) and the clamping element (4), is closed.

10. The plug-in connection according to claim 1, wherein the at least one bead is at a distance from the diameter of the sleeve (8).

11. The plug-in connection as recited in claim 1, wherein the sleeve (8) can be plugged directly onto the end of a cable.

12. The plug-in connection according to claim 1, wherein the clamping element is configured to fix the at least a part of the second contact element to the contact area.

13. The plug-in connection according to claim 1, wherein the outer surface includes at least two beads, the spacing between the at least two beads is less than the spacing between the at least two beads and a thickened regions of the sleeve.

14. The plug-in connection according to claim 1, wherein the sleeve has a thickened region spaced apart from the at least one bead in a direction of insertion of the second contact element.

15. The plug-in connection according to claim 1, wherein the sleeve includes an electrically conductive material which is slid over the contact area of the second contact element.

16. A removable electrical plug-in connection comprising:

a connector including a first contact element and a clamping element, the clamping element having an open position and a closed position; and a mating connector including a second contact element, wherein the first contact element is movable with respect to the second contact element in a contact area when the clamping element is in the open position, and the clamping element, when in the closed position, fixes the first contact element with respect to the second contact element in the contact area by pressing the first contact element and the second contact element together, wherein the second contact element (6) has a sleeve (8) at least in the contact area (7) for compensating different diameters of second contact elements (6), wherein an outer surface (9) of the sleeve (8) includes at least one bead (10) forming a contact point with the first contact element (3) in the contact area (7).

* * * * *